US009200412B2

(12) United States Patent
Robinson et al.

(10) Patent No.: US 9,200,412 B2
(45) Date of Patent: Dec. 1, 2015

(54) RAILWAY STONE BALLAST AND RELATED SYSTEMS AND METHODS

(71) Applicant: PCI-TRAMMCO, LLC, Camden, AL (US)

(72) Inventors: Glenn Robinson, Camden, AL (US); William H. Moorhead, Smithfield, VA (US)

( * ) Notice: Subject to any disclaimer, the term of this patent is extended or adjusted under 35 U.S.C. 154(b) by 137 days.

(21) Appl. No.: 13/764,035

(22) Filed: Feb. 11, 2013

(65) Prior Publication Data

US 2013/0206853 A1 Aug. 15, 2013

Related U.S. Application Data

(60) Provisional application No. 61/597,300, filed on Feb. 10, 2012.

(51) Int. Cl.
*E01B 1/00* (2006.01)

(52) U.S. Cl.
CPC .. *E01B 1/00* (2013.01); *E01B 1/001* (2013.01)

(58) Field of Classification Search
CPC ..... E01B 1/00; E01B 1/001
USPC ..... 238/2
See application file for complete search history.

(56) References Cited

U.S. PATENT DOCUMENTS

2006/0159526 A1 7/2006 Bonasso

FOREIGN PATENT DOCUMENTS

WO 2006042461 A1 4/2006
WO 2011084793 A1 7/2011

OTHER PUBLICATIONS

International Search Report and Written Opinion for PCT/US13/25540 (dated Apr. 12, 2013).

*Primary Examiner* — Zachary Kuhfuss
(74) *Attorney, Agent, or Firm* — McClure, Qualey & Rodack, LLP

(57) ABSTRACT

Railway stone ballast and related systems and methods are provided. A representative railway stone ballast includes a crushed stone matrix; rubber aggregate; and an adhesive binder adhering the rubber aggregate to the stone matrix.

7 Claims, 3 Drawing Sheets

RAILWAY STONE BALLAST AND RELATED SYSTEMS AND METHODS

CROSS REFERENCE TO RELATED APPLICATION

This utility application claims priority to U.S. Provisional application 61/597,300, filed Feb. 10, 2012, which is incorporated by reference herein in its entirety.

TECHNICAL FIELD

The present disclosure generally relates to stone ballast used in railways, both passenger and freight, rail transit such as subways or interurban, and ballasted light rail/streetcar tracks.

DESCRIPTION OF THE RELATED ART

The historic and current method used to support railway tracks of all kinds typically involves fastening the rails to crossties (sleepers) of various kinds and then to found the rails and crossties on a formation of unbound stone ballast of various depths depending on the weight of the rail vehicles, usually being of 8-in. to 12-in. depth under the crossties. The preferred stone ballast is made from hard rock types crushed into sharp-edged particles of specific sizes, usually in the size range from 2½-in. down to ½-in, the larger gradations being preferred. The ballast formation (section) usually extends out past the ends of the crossties from 6-in. to 12-in. and then slopes downward to the sub-ballast or subgrade and is generally trapezoidal when viewed in cross-section.

The primary failure mode of unbound stone ballast is the gradual destruction of the stone particles through abrasion and impact, resulting in abrasive wear generating fine particle fouling and fracture of the particles into smaller sizes. The heavier the axle loads, the faster the degradation. As the degradation takes place over time, the fine wear particles can form "mud" when subjected to sufficient moisture, reducing the shear strength of the ballast formation, resulting in subsidence of the track and accelerated wear of the remaining sound ballast. Usually, track speed must be reduced or slow-ordered as the track geometry degrades. Even so, derailments can occur because of severe differential settlement or general loss of track strength. Adding additional new ballast and raising and tamping the track can temporarily restore the proper track geometry, but once the fine particle fouling reaches a certain critical percentage, and lateral drainage is lost, the ballast must typically be removed and replaced with new material, a significant expense and delay of train traffic.

The progressive failure of unbound stone ballast has been a bane to the railways for over 170 years and is a major track maintenance expense. The introduction of concrete crossties (sleepers) in place of wood crossties after World War II has actually hastened the destruction of stone ballast because the concrete absorbs very little impact and vibration, both of which are damaging to the ballast stone. The wood crossties do absorb significant impact and vibration, but fail rapidly under heavy axle loads, loss of gauge holding ability, and adverse weather, and are relatively expensive to replace on a spot renewal basis.

In many places in the world, concrete slab track is employed in place of unbound stone ballasted track. Slab track has not been accepted by the North American railways, especially the freight carriers, as it is expensive to build and has potential maintenance issues, such as settlement, derailment damage, fastening system failures, and an unknown service life. In addition, most slab track in the world was built with public (taxpayer) money; freight railways in the United States are self-financing, and the high first-cost and unknown life-cycle cost (LCC) has discouraged use of slab track. The notable exception is in rail transit, which is generally publicly funded, and where slab track is fairly common because of demonstrably lower maintenance requirements and LCC's.

Summarizing, crushed stone ballast is relatively low first-cost, but can have poor performance and relatively high LCC's for the reasons enumerated above. Better overall ballast performance and lower LCC's would be a boon to all railways, and would possibly allow the use of tracks so improved to be used by both high-speed passenger and freight traffic.

SUMMARY

Railway stone ballast and related systems and methods are provided. Briefly described, one embodiment, among others, is a modified railway stone ballast comprising: a crushed stone matrix; rubber aggregate; and an adhesive binder adhering the rubber aggregate to the stone matrix.

Another example embodiment is a railway stone ballast system comprising: a track supporting system; and modified ballast supporting the track supporting system, the modified ballast comprising: a crushed stone matrix; rubber aggregate; and an adhesive binder adhering the rubber aggregate to the stone matrix.

Another example embodiment is a method for supporting railway track comprising: providing stone ballast particles; providing a resilient barrier layer of rubber aggregate between the stone ballast particles to form modified ballast particles; and using the modified ballast particles to support a trackform.

Other systems, methods, features, and/or advantages of the present disclosure will be or may become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure.

DETAILED DESCRIPTION

Railway stone ballast and related systems and methods are provided that may involve improvement of overall ballast performance and LCC's, several exemplary embodiments of which will be described in detail. In this regard, there are many variations of the embodiments depending on the characteristics desired and the specific application. Embodiments are based on coating ballast stone particles with a layer of adhesive-retained, tough rubber particles that allow small movements among the stone particles. This mixture will allow the ballast stone particles to move minutely relative to each other but will prevent abrasion and impact breakage of those particles, a unique concept. Those skilled in this art will realize that many embodiments based on the fundamental principles of this disclosure can be developed and applied in the field to address specific problems and site conditions.

Figure 1:
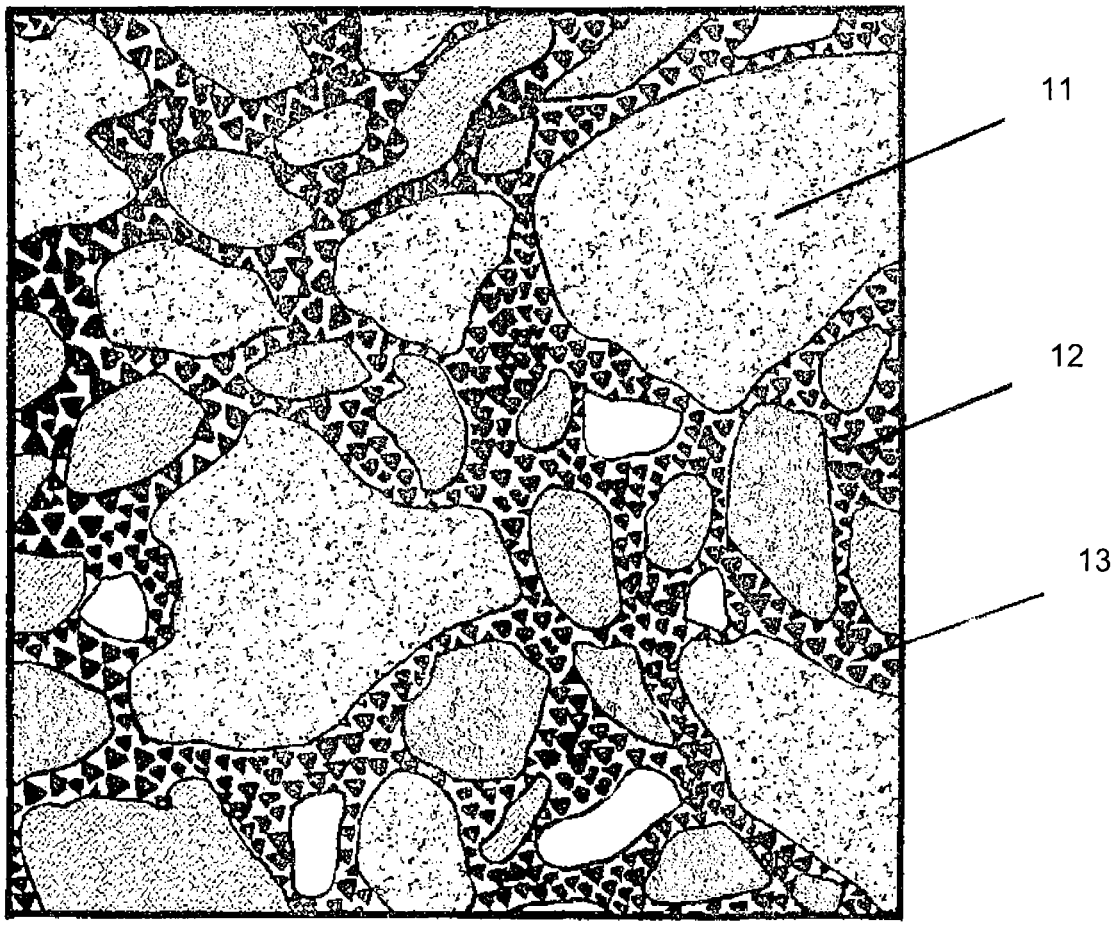
FIG. 1 is a schematic diagram showing a cross-section of an example embodiment of modified railway stone ballast.

An exemplary embodiment of railway stone ballast, which is depicted in the cross-sectional view of FIG. 1, comprises: hard-rock, crushed stone ballast 11; tire-derived aggregate (TDA) 12; and, a binder material 13. The three ingredients are mixed in differing proportions as required so as to obtain the appropriate stone ballast protective separation and the desired resilient support properties (see FIG. 1). The adhesive binder is not for the purpose of binding the ballast stones together, although superficially it may have that effect; the adhesive binder is for the purpose of adhering the TDA particles to the stone particles so as to provide a uniform, resilient, protective barrier layer between and among the stone particles, preventing the stones from impinging and rubbing on one another and thereby reduce or prevent the ballast degradation noted above. A secondary benefit of this embodiment is to provide controlled resilience in the ballast formation so as to obtain the desired track support modulus using conventional wood, concrete or plastic crosstie construction or a ladder track construction without the usage of special fastening systems.

Figure 2:
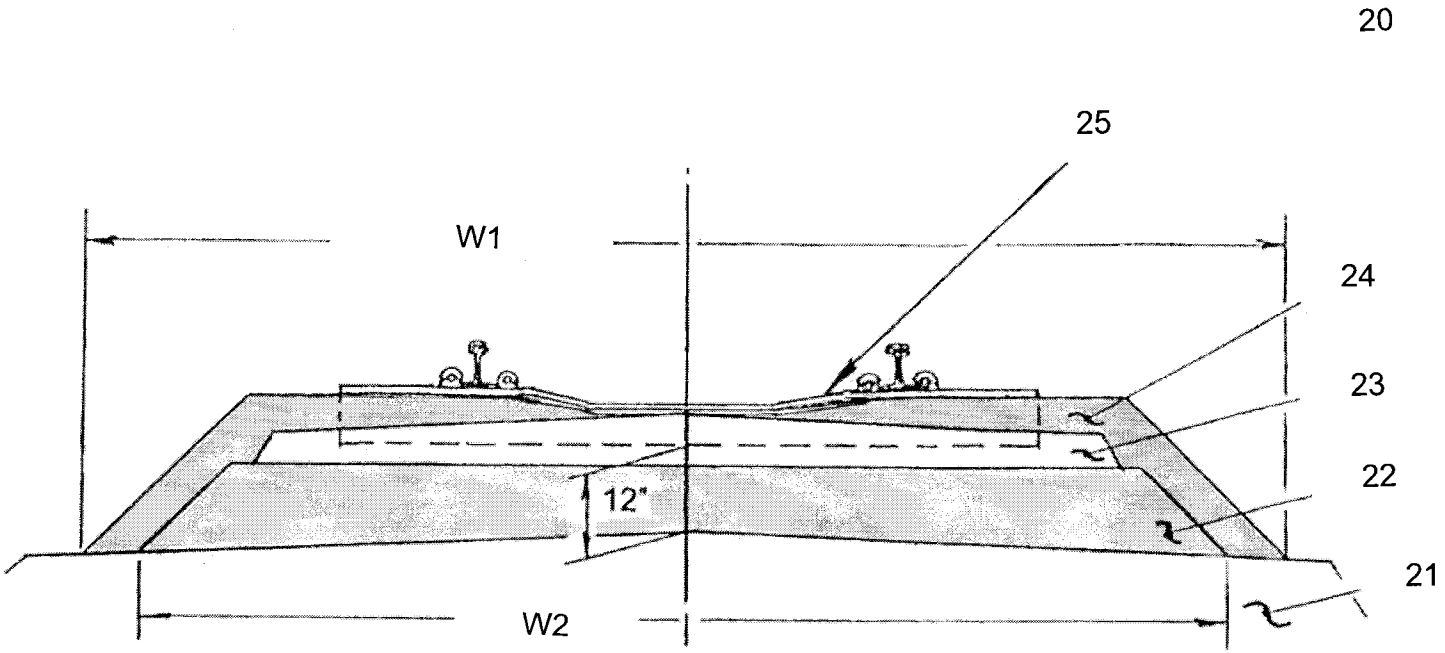
FIG. 2 is a schematic diagram showing an example embodiment of a track section formed using modified railway stone ballast.

FIG. 2 is a schematic diagram showing an example embodiment of a track section formed using modified railway stone ballast. As shown in FIG. 2, system 20 includes a layer 21 comprising a prepared subgrade of compacted select material. In some embodiments, layer 21 may be reinforced with geo-textile fabric, Geocell, or other reinforcement depending on the site conditions.

A layer 22 of railway stone ballast is positioned over layer 21 that includes small gradation ballast and single gradation TDA. Notably, this layer exhibits relatively higher resilience and provides most of the track modulus value. It is also fairly pervious.

A layer 23 of railway stone ballast is positioned over layer 22 that includes small gradation ballast and two gradations of TDA. This "Bedding Layer" exhibits relatively stiff modulus to hold ties and distribute loads evenly to layer 21. Layer 22 is relatively impervious.

A layer 24 of medium gradation granular ballast is positioned over layer 23. Layer 24 is shaped and optionally retained with an epoxy spray similar to Swiss method to repel sand and provide catchment space in the guage of the track.

Slab track 25 is positioned on layer 24 and incorporates standard concrete crossties and rail fastenings (e.g., W1 is approximately 14' 0" and W2 is approximately 12' 8"). The modified ballast layers are formed of mixes of crushed stone ballast, TDA (of several gradations) and an epoxy binder with extensibility, temperature stability, easy mixing and suitable strength and elastic properties. The layers may be compounded to provide the required load support capability and deflection (e.g., 3 mm) under operating loads at total strain rates of 1.0-1.5%.

Those skilled in the art will recognize that embodiments (such as that shown in FIG. 2, for example) may provide one or more significant benefits, such as:

1. Providing a ballast complete track structure, or as an overlayment or underlayment, all of which have a controllable, consistent track modulus & supporting strength, and that use readily available, economical materials
2. Providing an adequate cushioning to tolerate high impact loads without degradation
3. Be unchanging dimensionally and in performance characteristics over a long service life
4. Be pervious and drain well; or, in embedded applications, they can be made in waterproof and weatherproof formulations and have support properties unaffected by the level of surface or ground water
5. Providing the quality of ride to trains virtually the same as high-quality, perfectly-surfaced wood crosstie, ballasted track with respect to sound, feel, and ride comfort
6. Reducing both ground-borne vibration and airborne noise generated by passing trains
7. Be constructed, repaired or replaced in short work windows with standard equipment
8. Be very "green" by having the potential to safely remove large quantities of scrap tires from the waste stream An example embodiment involves the use of a crushed, hard-rock stone ballast conforming to AREMA specification #57 in a proportion of 82.5% by weight; 1-3 mm gradation TDA 15% by weight; and epoxy binder at 2.5% by weight. This mixture will be relatively "soft" relative to the support modulus, and can be used as a full-depth ballast support for rail transit where the applied loading at the crosstie/RBB interface does not exceed approximately 60 psi. This same formulation can be used as an underlayment layer in a two-layer (or more) full-depth slab construction, or as an overlayment layer over granular ballast in light axle load applications, or heavy axle loads where track speeds are low.

Another example embodiment involves the use of a crushed, hard-rock stone ballast conforming to AREMA specification #57 in a proportion of 82.25% by weight; 1-3 mm gradation TDA 10% by weight and minus 30 mesh TDA 5% by weight; and epoxy binder at 2.75% by weight. This mixture will be relatively "hard" relative to the support modulus, and can be used as a top layer in a two-layer, full-depth ballast support for freight railways or high-speed passenger railways where the applied loading at the crosstie/RBB interface does not exceed approximately 100 psi. This same type formulation can be used as a full-depth support slab construction where the depth of slab is limited by physical and operational restraints such as tunnels, open deck bridge conversions, and under catenary traction power contact wires.

Another example embodiment involves the pre-cast formation of RBB into prismatic particles generally in the 1" by 1½" size range having five or six angular sides viewed in cross-section, with pointed ends. These RBB particles are mixed with normal stone ballast to act as barrier particles to reduce the impact and abrasion among the bare stones, and provide a level of resilience in the formation not achieved with stone alone.

Other formulations can be made to obtain different characteristics, using different stone gradations, sizes and proportions of TDA, and type and proportion of adhesive binder. These variations can modify the characteristics such as the support modulus, permeability or impermeability, or strength by using additional admixtures such as chopped glass reinforcement to resist "creep" in bridge applications. Other admixture materials can be used to provide better weathering characteristics, waterproofing, better stray current control, etc. Those skilled in the art will recognize that the basic building blocks can be arranged in many ways to satisfy the requirements of specific applications, such as "grass track" and areas where maximum ground-borne vibration control is needed.

The ballast may be mixed on-site using several different commercially available mixers, such as small or large drum mixers, pug mills, pan mixers, and planetary mixers, depending on the volumes needed for specific projects. Generally, the mix involves mixing the binder (e.g., epoxy and activator) and allowing an "induction" (reaction) period for a short time before adding the epoxy to the stones. Then the epoxy and stone matrix are thoroughly mixed to completely "wet" the stone surfaces with the epoxy adhesive. Next, the TDA is mixed with the epoxy adhesive separately to completely "wet" all TDA surfaces with epoxy. Lastly, the wetted TDA is introduced into the wetted stone mix and thoroughly mixed to be sure that the stone particle surfaces are completely coated with the TDA particles to form an unbroken resilient barrier between and among the stones. The resulting mix is then placed using a variety of tools and/or equipment, including hand tools, curb & gutter forming machines, modified asphalt pavers & power screeds, and purpose-designed machines to form the railway ballast section in one pass. The placed ballast is consolidated by using vibratory compactors similar to those used for RCC and HMA, and is finished with hand tools similar to paving finishing tools.

Figure 3:
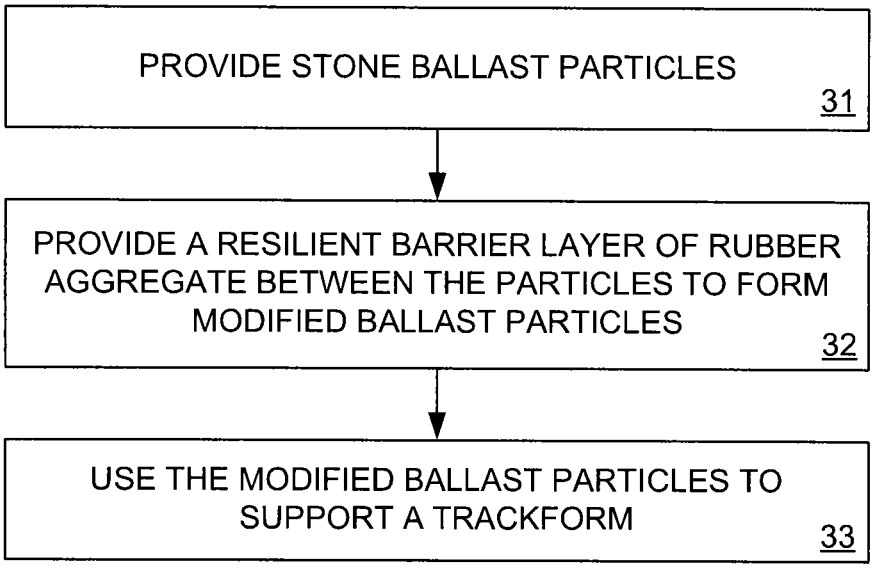
FIG. 3 is a flowchart depicting an example embodiment of a method for supporting railway track.

FIG. 3 is a flowchart depicting an example embodiment of a method for supporting railway track. As shown in FIG. 3, the method may be construed as beginning at block 31, in which stone ballast particles are provided. In block 32, a resilient barrier layer of rubber aggregate is provided between the stone ballast particles to form modified ballast particles. Then, as depicted in block 33, the modified ballast particles are used to support a trackform.

As set forth above, various embodiments may modify railway stone ballast to improve its performance and service life, while forming a permanent trackform that provides a support with controlled resilience resulting in a greatly extended ballast service life, a better ride, and reduction of airborne noise and ground-borne vibration. Such embodiments may improve the service life of the track geometry, the subgrade, and also reduce the maintenance requirements, which may be competitive with all other trackforms on a life-cycle cost basis.

It should be emphasized that the above-described embodiments are merely examples of possible implementations. Many variations and modifications may be made to the above-described embodiments without departing from the principles of the present disclosure. It should be noted that, in some of the description and figures, the terms Resilient Bound Ballast (RBB) are used—these terms are being used to denote modified railway stone ballast.

All such modifications and variations are intended to be included herein within the scope of this disclosure and protected by the following claims.

The invention claimed is:

1. A method for supporting railway track comprising:

providing stone ballast particles;

wetting the stone ballast particles with epoxy adhesive binder;

providing rubber aggregate;

separately wetting the rubber aggregate with epoxy adhesive binder;

mixing the stone ballast particles wetted with the epoxy and the rubber aggregate wetted with the epoxy such that the stone ballast particles are coated with the rubber aggregate and a resilient barrier layer of the rubber aggregate is positioned between the stone ballast particles to form modified ballast; and using the modified ballast to support a trackform.

2. The method of claim 1, wherein using the modified ballast reduces airborne noise and ground-borne vibration generated by passing trains.

3. The method of claim 1, wherein providing the resilient barrier layer is performed in a factory.

4. The method of claims 1, wherein providing the resilient barrier layer is performed on-site.

5. A method for forming modified stone ballast comprising:

providing stone ballast particles;

wetting the stone ballast particles with epoxy adhesive binder;

providing rubber aggregate;

separately wetting the rubber aggregate with epoxy adhesive binder;

mixing the stone ballast particles wetted with the epoxy and the rubber aggregate wetted with the epoxy such that the stone ballast particles are coated with the rubber aggregate and a resilient barrier layer of the rubber aggregate is positioned between the stone ballast particles to form modified stone ballast.

6. The ballast of claim 5, wherein, in the modified stone ballast matrix, the rubber aggregate is approximately 15% by weight.

7. The ballast of claim 5, wherein, in the modified stone ballast matrix, the epoxy resin adhesive binder is between approximately 2.5% and approximately 2.75% by weight.

* * * * *